United States Patent [19]

Kinder

[11] 4,380,126

[45] Apr. 19, 1983

[54] HEAT RECYCLING APPARATUS

[76] Inventor: Horton C. Kinder, 2524 Springfield Ave., Fort Wayne, Ind. 46805

[21] Appl. No.: 269,726

[22] Filed: Jun. 2, 1981

[51] Int. Cl.[3] ..... F26B 11/04

[52] U.S. Cl. ..... 34/86; 34/131; 34/133

[58] Field of Search ..... 34/86, 133, 131; 432/105, 176

[56] References Cited

U.S. PATENT DOCUMENTS

| | | | |
|---|---|---|---|
| 3,959,892 | 6/1976 | Cloud et al. | 34/86 |
| 4,106,214 | 8/1978 | Schmidt | 34/86 |
| 4,207,056 | 6/1980 | Bowley | 34/86 |
| 4,275,510 | 6/1981 | George | 34/86 |

*Primary Examiner*—Larry I. Schwartz
*Attorney, Agent, or Firm*—David A. Lundy

[57] ABSTRACT

A heat recycling apparatus operatively connected to a hot air chamber having an exhaust pipe and an intake. The apparatus includes an intake conduit having one end in which there is an opening. A peripheral edge surrounds the opening. The exhaust pipe has an aperture therein through which the one end of the intake conduit extends into the exhaust pipe. The peripheral edge is generally perpendicularly disposed with respect to the longitudinal axis of the exhaust pipe. The opening has an area of between approximately 30% and approximately 65% of the area of the exhaust pipe. A portion of the peripheral edge is contiguous with the wall of the exhaust pipe. The other end of the intake conduit is connected to the hot air chamber.

8 Claims, 5 Drawing Figures

HEAT RECYCLING APPARATUS

BACKGROUND OF THE INVENTION

This invention pertains to an apparatus for recycling heat, and more particularly, to a heat recycling apparatus operatively connected to a hot air chamber so as to recycle heat back through the chamber.

The present high cost of energy and the expectation of the future promising no relief in the continued increase in energy costs has caused many, if not all, industries to search for ways to reduce energy consumption. In the area of heating air for drying purposes, it is desirable to reduce oil, electrical and/or gas consumption and still maintain the required heating efficiency. One way to reduce energy costs would be to preheat air entering the drying chamber.

In the past, apparatus for attachment to drying chambers for recycling exhaust air therethrough have been utilized. However, these devices have not been without problems. In order to accommodate the installation of these devices, structural changes have had to be made to the drying apparatus. These structural changes have, in some cases, lowered the safety factor built into the drying apparatus and decreased the operational efficiencies of the drying chamber. Both of these results are undesirable. Thus, it would be highly desirable to provide an improved apparatus for recycling heat that when attached to the drying apparatus does not lower the safety factor built into the drying apparatus or decrease the operational efficiencies of the drying chamber.

Heretofore, the junction of the intake and exhaust pipe has created undesirable operating characteristics in earlier apparatus. The intake was positioned within the exhaust pipe so as to create a so-called "dead air space" therebetween. This "dead air space" created a location where lint could build up. This lint build-up decreased the efficiency of the apparatus.

This "dead air space" also caused the generally laminar flow of air through the exhaust pipe to become turbulent. This turbulence decreased the volume flow rate through the apparatus which decreased the efficiency thereof. This decrease in air flow also caused lint to drop out of the air flow which further decreased the efficiency.

It would be highly desirable to provide an improved apparatus for recycling heat through a hot air chamber that does not provide a location for lint accumulation adjacent the intake vent or create turbulence adjacent to the intake vent.

Earlier apparatus directed the recycled air flow in the general direction of the flame in the fire box. This created an inconsistency in the heating of fresh air passing over the flame. Thus, it would be highly desirable to provide an improved apparatus for recycling heat through a hot air chamber wherein the recycled air does not adversely affect the performance of the flame.

SUMMARY OF THE INVENTION

It is an object of the invention to provide an improved apparatus for recycling heat through a hot air chamber.

It is an object of the invention to provide an improved apparatus for recycling heat through a hot air chamber that when attached to the drying apparatus does not lower the safety factor built into the drying apparatus.

It is another object of the invention to provide an improved apparatus for recycling heat through a hot air chamber that when attached to the drying apparatus does not decrease the operational efficiencies of the drying apparatus.

It is an object of the invention to provide an improved apparatus for recycling heat through a hot air chamber that does not provide a location for lint accumulation adjacent the intake vent or create turbulence adjacent the intake vent.

Finally, it is an object of the invention to provide an improved apparatus for recycling heated air through a hot air drying chamber that provides for an undisturbed operation of the heating flame of the drying apparatus.

The invention is a heat recycling apparatus operatively connected to a hot air chamber having an exhaust pipe and an intake. The apparatus comprises an intake having one end. This one end has an opening surrounded by a peripheral edge. The exhaust pipe has an aperture therein. The one end of the intake protrudes into the exhaust pipe through the aperture so that the peripheral edge is generally perpendicularly disposed with respect to the longitudinal axis of the exhaust pipe. The opening has an area of between approximately 30 percent and approximately 65 percent of the cross-sectional area of the exhaust pipe. A portion of the peripheral edge is contiguous with the wall of the exhaust pipe. The other end of the intake conduit is connected to the hot air chamber.

BRIEF DESCRIPTION OF THE DRAWINGS

The above-mentioned and other features and objects of this invention and the manner of obtaining them will become more apparent and the invention itself will be better understood by reference to the following description of an embodiment of the invention taken in conjunction with accompanying drawings, wherein.

DESCRIPTION OF A SPECIFIC EMBODIMENT

Figure 1:
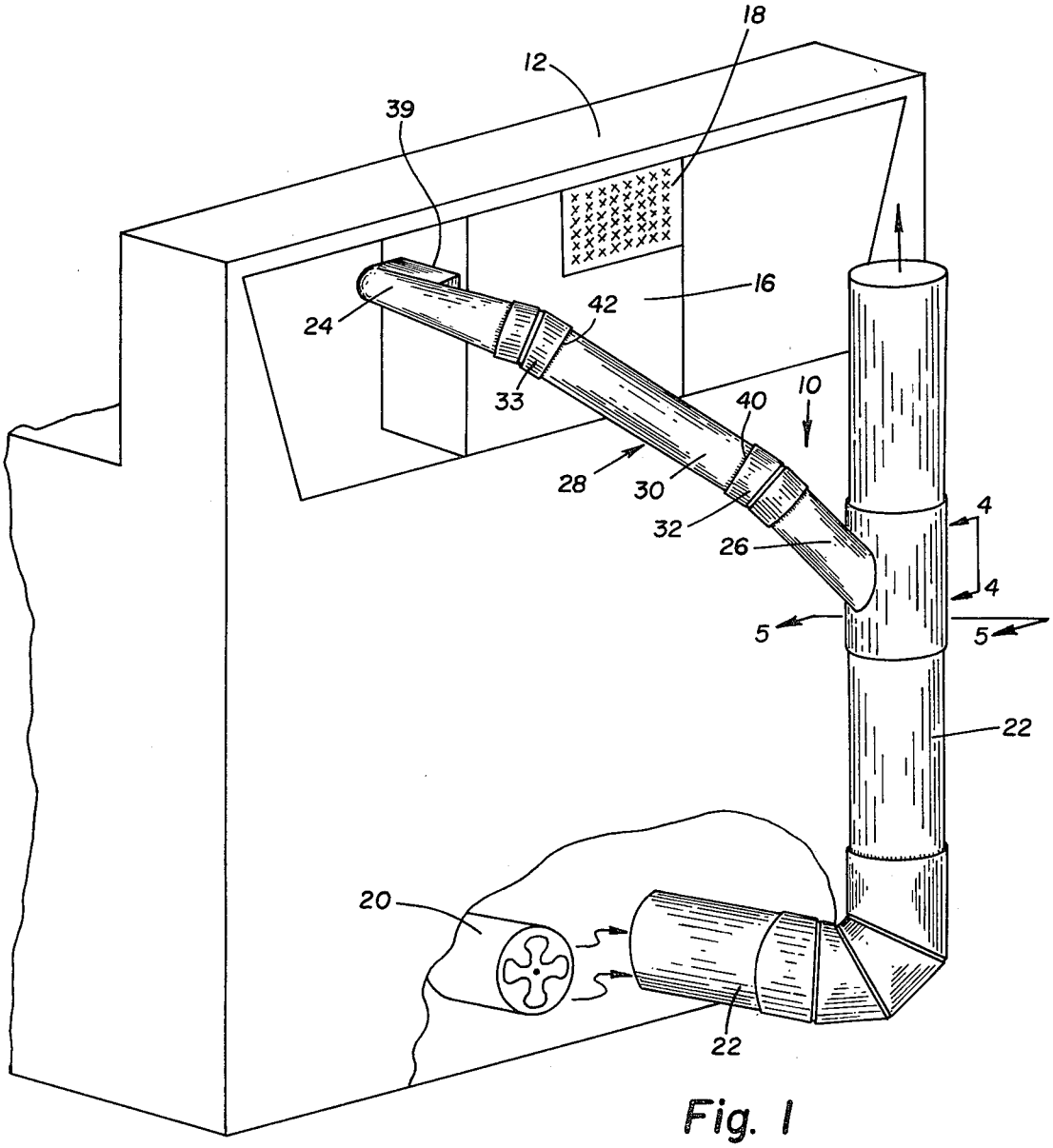
FIG. 1 is a perspective view of a specific embodiment of the invention connected to a drying apparatus with back panel removed.
Figure 2:
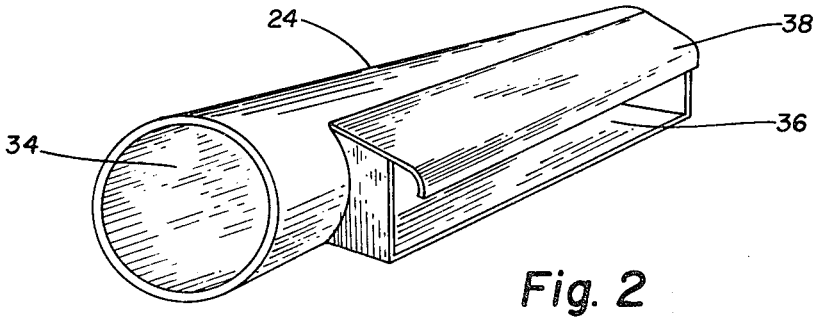
FIG. 2 is a perspective view of the exhaust vent of the specific embodiment illustrated in FIG. 1.
Figure 3:
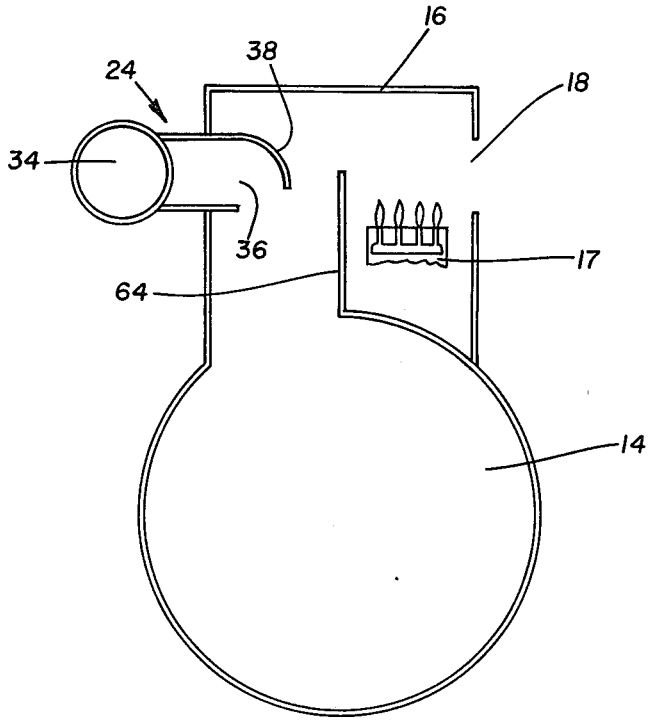
FIG. 3 is a schematic view of the exhaust of the specific embodiment illustrated in FIG. 1 depicting the relationship between itself and the flame assembly of the drying apparatus.
Figure 4:
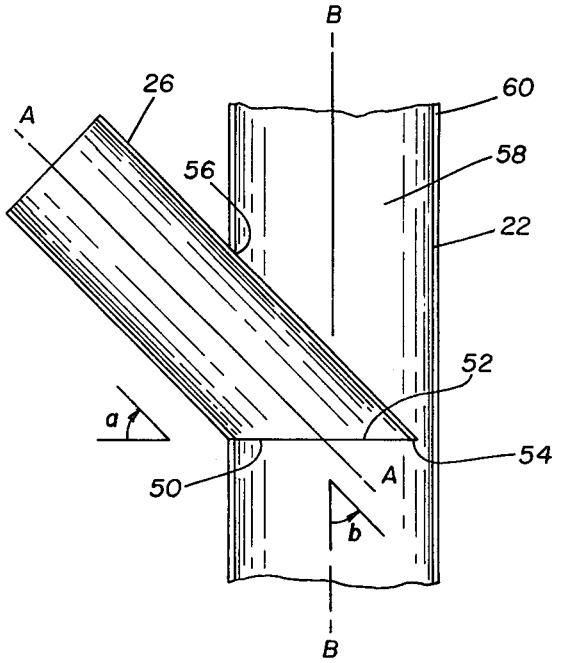
FIG. 4 is a cross-sectional view of the specific embodiment illustrated in FIG. 1 taken along section line 4—4.
Figure 5:
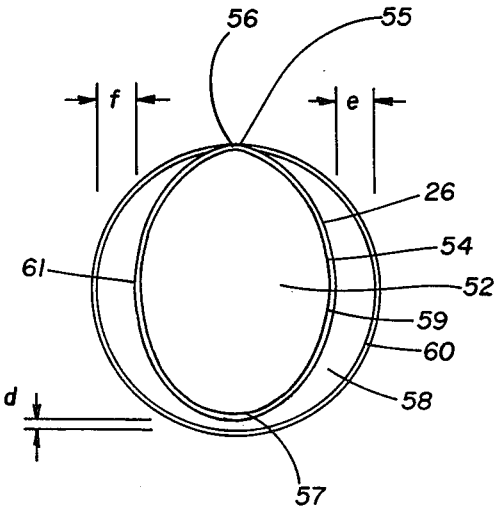
FIG. 5 is a cross-sectional view of the specific embodiment illustrated in FIG. 1 taken along section line 5—5.

Referring to the drawings, the heat recycling apparatus generally designated 10 is shown installed on a drying apparatus 12. In the specific embodiment illustrated, the drying apparatus is a clothes dryer such as those sold under the trademarks "Sahara" or "Speed Queen" by Huebsch Mfg. Co.

Drying apparatus 12 includes a drying chamber 14 and a fire box or hot air chamber 16. Fire box 16 has a flame assembly 17. A plurality of chamber intakes 18 pass through a fire box 16 and communicate with drying chamber 14. A blower 20 is attached to the drying apparatus. Blower 20 provides essentially all of the driving force to move the air through the heat transfer apparatus and drying apparatus. Specifically, blower 20 draws outside air into and through the chamber intakes 18, through the drying chamber, and out through a chamber exhaust pipe 22.

Heat recycling apparatus 10 includes an intake conduit 28 having an exhaust vent or end 24 and an intake vent or end 26 connected by an adjustable conduit assembly. Adjustable conduit assembly 28 includes a conduit 30 having an inlet 40 and outlet 42. One elbow 32 connects conduit 30 at inlet 40 thereof to intake vent 26. Second elbow 33 connects conduit 30 at outlet 42 thereof to the exhaust vent 24. These connections may be made via bolts, tab locks, soder, tape, wrap arounds or the like.

It is apparent that a variable number of conduits and elbows can be used. Adjustable conduit assembly 28 provides this feature so that the apparatus 10 can be connected to drying apparatus 12 of varying sizes and configurations without structural modification of drying apparatus 12. The absence of any need to make structural changes to the drying apparatus is advantageous. The absence of structural changes allows the operating characteristics of the drying apparatus to remain unchanged when the heat recycling apparatus is connected thereto as compared when it is not. Exemplary of this feature is the maintenance of any inherent safety features the maintenance to a similar volume of air flow, the maintenance of combustion characteristics and the maintenance of other operating characteristics.

Although the specific embodiment illustrated depicts one section of conduit 30 and two elbows 32 and 33, it is not intended by applicant that this specific embodiment limit in any way the scope of applicant's invention. The specific number of conduits 30 and elbows 32, 33 is dependent on the specific application.

Exhaust vent 24 includes an inlet 34 at one end thereof and an outlet 36 surrounded by peripheral lip 38 at the other end thereof. Exhaust vent 24 is connected to the drying apparatus at an opening 39. Exhaust vent 24 is in communication with fire box 16 via opening 39. Peripheral lip 38 is disposed adjacent to outlet 36 so as to deflect exhaust air away from flame assembly 17 and towards drying chamber 14.

Intake vent 26 has opposite ends with an opening 50 at one end 52 thereof and an outlet at the other end thereof. A peripheral edge 54 surrounds opening 50. Peripheral edge 54 is illustrated as being disposed at an angle "a" equal to approximately 45° with respect to the longitudinal axis A—A of intake vent 26. However, angle "a" may be equal to between approximately 30° and approximately 50° and still provide efficient operation.

One end 52 of intake vent 26 is inserted in an aperture 56 contained in the wall of exhaust pipe 22 so as to extend within the channel 58 of the exhaust pipe 22. Peripheral edge 54 is generally perpendicularly disposed with respect to the longitudinal axis B—B of exhaust pipe 22. In order that this is accomplished, the intake vent should be positioned so that the angle "b" between the longitudinal axis A—A of the intake vent and the longitudinal axis B—B of the exhaust pipe should be between approximately 40° and approximately 50°. In the specific embodiment illustrated, angle "b" is equal to approximately 45° since angle "a" is equal to approximately 45°.

The cross-sectional area of the intake vent is generally between approximately 30 percent to approximately 65 percent of the cross-sectional area of the exhaust pipe. Consequently, when intake vent 26 is positioned so as to present peripheral lip 54 in a generally perpendicularly disposed fashion with respect to axis B—B, approximately 30 percent to approximately 65 percent of the air exiting the drying chamber through exhaust pipe 22 is recycled.

Peripheral lip 54 is cut into vent at an angle so as to present an eliptical shape. Intake vent 26 is positioned within aperture 56 so that the portion 55 of peripheral lip 54 nearest aperture 56 is contiguous with wall 60 of exhaust pipe 22 at the most upstream portion of aperture 56. When intake vent 26 is positioned in this fashion no portion of the wall thereof is directly presented to the flow of air through channel 58. This eliminates any so-called "dead air space" adjacent the junction of the intake vent and exhaust pipe. This then eliminates any site at which lint can build up or at which turbulence can be generated.

The portion 57 of lip 54 opposite portion 55 is spaced a distance "d" away from the adjacent portion of exhaust pipe 22. The portions 59 and 61 of lip 54 positioned 90° and 270° from portion 55, respectively, are spaced distances "e" and "f" away from the adjacent portions of exhaust pipe 22. The distances "d", "e" and "f" must be such that the volume of air flow adjacent opening 50 and the temperature of exhaust pipe 22 are maintained. The importance of these features will be discussed below.

OPERATION

In operation, outside or fresh air is drawn into the intakes 18 by blower 20. This air passes through fire box 16 so that flame assembly 17 heats the fresh air. This heated fresh air then passes over baffle 64 and enters drying chamber 14. This air then exits drying chamber 14, passes through the lint trap and exits through exhaust pipe 22. It is now at this point in the operation of the drying apparatus that applicant's structure is utilized.

Air carried in exhaust pipe 22 is, of course, cooler and wetter than when it first entered the drying chamber. It also contains some particulates (e.g. lint particles) and some combustion gases from the heating operation of flame assembly 17. However, this air is warmer than the fresh air first drawn into the intake pipes.

From between about 30 percent and about 65 percent of this air exiting drying chamber 14 enters intake vent 26 through opening 50. As previously mentioned, applicant's structure does not present a "dead air space" that provides a location for lint to build up or to generate turbulence.

Further, intake vent 26 is positioned within exhaust pipe 22 so that distance "d" is of a sufficient magnitude to not create a location for lint build up or to not constitute a restriction that would generate turbulence.

Reduced lint build up enhances the operating efficiencies of the heat recycling apparatus. The reduction of turbulence also enhances the operating efficiencies of the heat recycling apparatus.

Applicant's structure requires that the unrecycled air flow adjacent the wall of the exhaust pipe so as to maintain the exhaust pipe at a relatively warm temperature. By maintaining exhaust pipe 22 at this temperature, the chances that condensation will occur on the interior of the exhaust pipe are reduced. The reduction of condensation is advantageous since condensation picks up lint. The intake vent is positioned within exhaust pipe 22 so that distances "e" and "f" are sufficient to provide for the non-diminished flow of air. A diminished air flow through the exhaust pipe would allow lint particles to drop out and accumulate adjacent the intake vent. Thus, the maintenance of a non-diminished air flow through the exhaust pipe is advantageous.

It should be appreciated that the air exiting the drying chamber is not fully saturated with water so that it still has the capability of drying when recycled to the drying chamber. From the results of testing it is apparent that any increased moisture in the recycled air is offset by the increased temperature of this recycled air.

Air entering intake vent 26 is transported via adjustable conduit assembly 28 to exhaust vent 24. This air is discharged from exhaust vent 24 in the general direction of flame assembly 17. In earlier devices, the passage of recycled air disturbed the uniform operation of the flame. This could hinder the uniform application of heat to fresh air entering the drying chamber.

However, in applicant's apparatus, air is deflected by peripheral lip 38 away from flame assembly 17 and towards drying chamber 14. This preheated recycled air then passes into the drying chamber. Thus, some of the heat that passes out of the drying chamber is reused therein.

Table 1 below presents results of four test runs of a "Speed Queen" Model 37 AD dryer with and without the heat recycling apparatus installed. As can be seen, the connection of the apparatus to the dryer yields a savings in energy cost of between about 35 percent to about 52 percent.

TABLE 1

| | Test Runs For a "Speed Queen" Model 37 AD Dryer | | |
|---|---|---|---|
| Test # | Flame Time* Without Heat Recycle | Flame Time* With Heat Recycle | Reduction of Flame Time* |
| 1 | 52.4% | 33.9% | 35.3% |
| 2 | 65.3% | 36.8% | 43.6% |
| 3 | 48.0% | 30.0% | 37.5% |
| 4 | 83.0% | 40.5% | 51.2% |

The above data applies to 50 lb and 30 lb dryers
*Flame Time refers to the percentage of time that the flame was burning during the total drying time.

While there have been described above the principles of this invention in connection with the specific device, it is to be clearly understood that this description is made only by way of example and not as a limitation of the scope of the invention.

What is claimed is:

1. A heat recycling apparatus operatively connected to a hot air chamber having an exhaust pipe, said apparatus comprising: an intake conduit having opposite ends, one of said conduit ends having an opening surrounded by a peripheral edge, said exhaust pipe having an aperture therein, said one intake conduit end extending into said exhaust pipe through said aperture, said opening having an area of between approximately 30% and approximately 65% of the cross-sectional area of said exhaust pipe, said peripheral edge being disposed tangent to said exhaust pipe and in a plane perpendicular to the longitudinal axis of said exhaust pipe passing through the most upstream point of said aperture thereby minimizing dead air space at the junction of said intake conduit and said exhaust pipe; the other of said conduit ends being connected to said hot air chamber, thereby providing recycled exhaust air to said hot air chamber without excessive lint accumulation.

2. The device of claim 1 wherein the longitudinal axis of said one intake conduit end is disposed at an angle of between approximately 40° and approximately 50° with respect to the longitudinal axis of said exhaust pipe.

3. The device of claim 1 wherein said peripheral edge is generally eliptically shaped.

4. The device of claim 1 wherein said other intake conduit end has a peripheral lip positioned to deflect air exiting said intake conduit away from the flame assembly of said hot air chamber.

5. An adjustable heat recycling apparatus detachably connected to a drying apparatus for recycling exhaust air from a drying chamber back through the drying chamber, the drying apparatus having a hot air chamber and an exhaust pipe, the apparatus comprising: an intake conduit having opposite ends, one of said conduit ends having an opening surrounded by a peripheral edge, said exhaust pipe having an aperture in the wall thereof, said one intake conduit end extending into said exhaust pipe through said aperture said peripheral edge being disposed tangent to said exhaust pipe and in a plane perpendicular to the longitudinal axis of said exhaust pipe passing through the most upstream point of said aperture, the other of said conduit ends being connected to said hot air chamber, thereby providing recycled exhaust air to said hot air chamber without excessive lint accumulation.

6. The device of claim 5 wherein said opening has an area of between approximately 30 percent and approximately 65 percent of the area of said exhaust pipe.

7. The device of claim 5 wherein said other of said intake conduit ends includes means for deflecting recycled air away from a flame assembly in said drying chamber.

8. The device of claim 7 wherein said means comprises a peripheral lip on which the recycled air impinges upon so that the direction of air flow is changed.

* * * * *